US005233712A

United States Patent [19]

Jurus et al.

[11] Patent Number: 5,233,712

[45] Date of Patent: Aug. 10, 1993

[54] PRESSURE RELIEF BED

[76] Inventors: David Jurus, 15350 S. Central Ave., Oak Forest, Ill. 60452; Kevin Jurus, 1418 Elmwood Rd., Lansing, Mich. 48917

[21] Appl. No.: 920,204

[22] Filed: Jul. 27, 1992

[51] Int. Cl.[5] ..... A61G 7/057

[52] U.S. Cl. ..... 5/613; 5/611; 5/934; 128/33

[58] Field of Search ..... 5/613, 616, 611, 600, 5/933, 934; 128/33

[56] References Cited

U.S. PATENT DOCUMENTS

| | | | |
|---|---|---|---|
| 2,112,702 | 3/1938 | Loibl | 5/934 |
| 3,298,363 | 1/1967 | Parkin | 5/934 |
| 3,656,190 | 4/1972 | Regan et al. | 5/613 |
| 4,999,861 | 3/1991 | Huang | 5/934 |
| 5,109,558 | 5/1992 | Di Blasi | 5/613 |

FOREIGN PATENT DOCUMENTS

| | | | |
|---|---|---|---|
| 1292768 | 2/1987 | U.S.S.R. | 5/934 |

*Primary Examiner*—Alexander Grosz
*Attorney, Agent, or Firm*—Allegretti & Witcoff, Ltd.

[57] ABSTRACT

A pressure relief bed which supports the body of a patient on two racks, each of which carries a series of parallel, closely-shaped padded slats. The slats on one rack are interposed between the slats on the other rack. The structure includes means for alternately moving one rack and the slats thereon out of contact with the patient's body while the other rack, and the slats thereon, support the body.

8 Claims, 3 Drawing Sheets

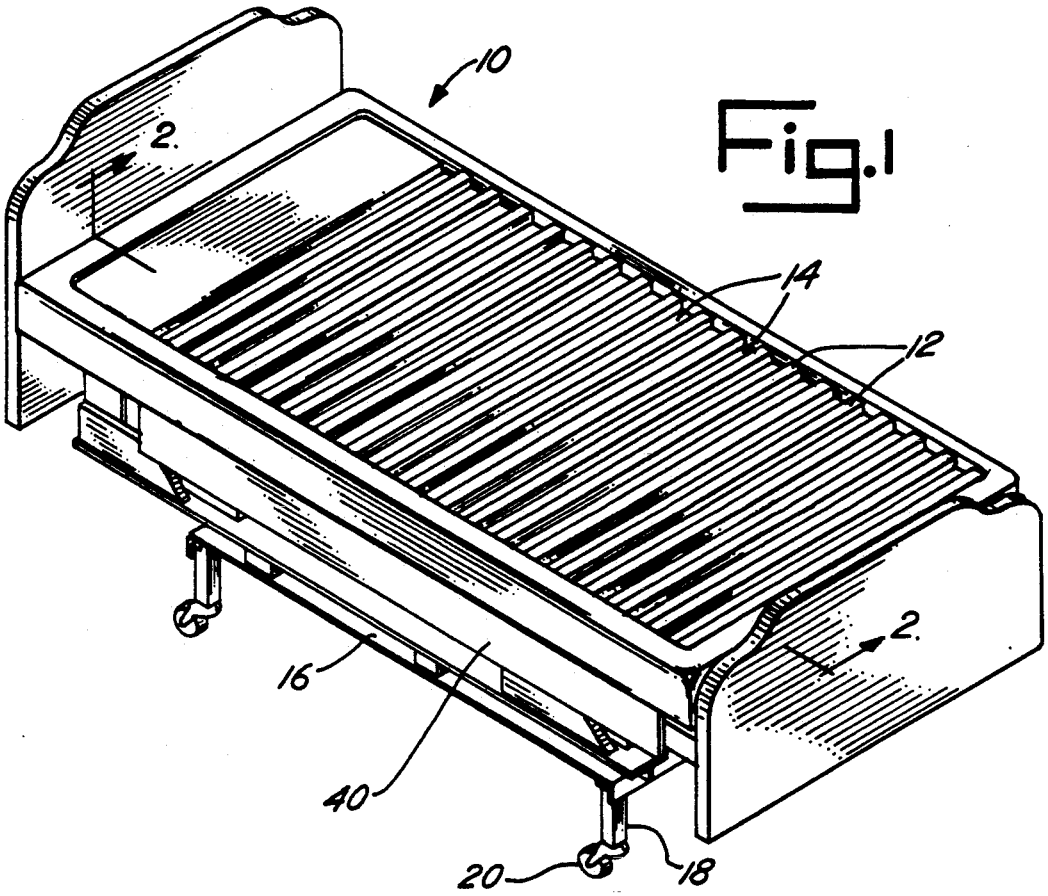
Fig. 1
Fig. 2
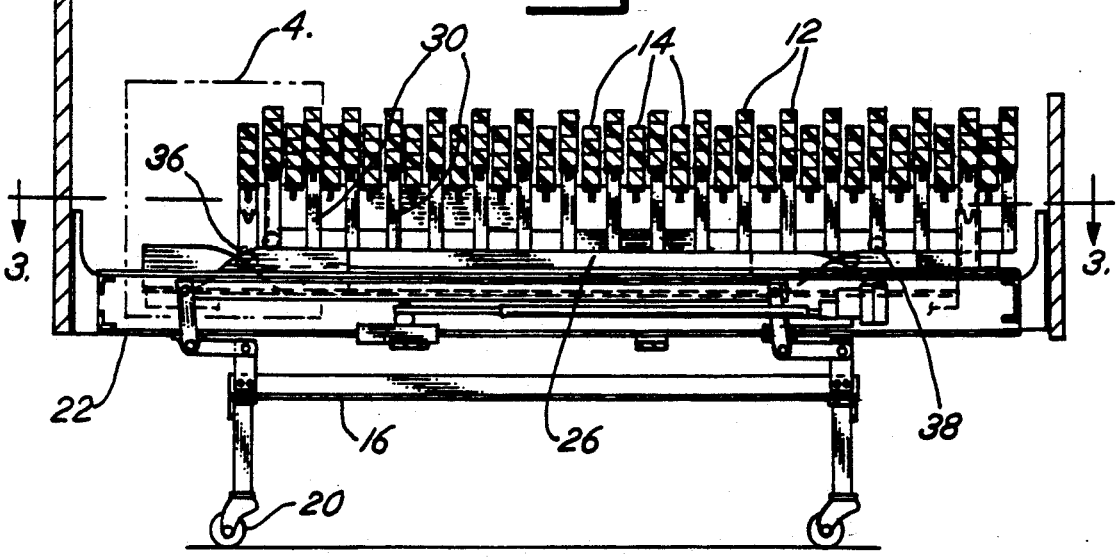

PRESSURE RELIEF BED

BACKGROUND OF THE INVENTION

This invention relates to beds for the prevention or curing of decubitus ulcers.

PRIOR ART

Various bed and support structures for reducing the pressure on the skin of bed-bound patients have been disclosed. The literature states surface pressure on the skin preferably should be reduced to zero to prevent the formation of decubitus ulcers. These ulcers form when external pressure arrests the flow of blood to the soft tissue. Because the weight of the patient must be supported by the mattress or other support surface, it is not possible to reduce the pressure on all skin areas to zero. Consequently, prior devices have a series of spaced parallel supports such as air filled tubular chambers or cells which are alternately inflated and deflated at periodic intervals. The inflated cells support the patient while deflated cells are spaced from the body of the patient.

Many of the devices proposed to heal or prevent formation of ulcers are designed to eliminate the mechanical forces that cause tissue breakdown. It has been proposed to place the patient on a fluidized bed and introduce warmed compressed air through a porous surface beneath the patient to heal the wounds.

One of the devices currently on the market using pneumatic cells which are inflated and deflated is identified by the trademark Pegasus Air Wave. It is designed to eliminate pressure to zero in the skin areas between raised inflated tubes. The inflation is cyclical so that the reduced pressure between inflated tubes extends for 1½ to 2 minutes followed by 5 minutes full body pressure while the tube is inflated. It is alleged that this mattress provides zero pressure twenty percent (20%) of the time. However, in the regions of bony prominence and in other areas where the body weight is concentrated, the tubes compress and the surface widens so that the skin is in contact with the widened surface. This is especially true when the patient is heavy, over 200 pounds. Heavy patients may cause the inflated tubes to bottom out, particularly under bony prominences so that body contact is made with the deflated tubes. Thus, the objective of obtaining zero pressure on the skin is frustrated. If the tubes are inflated sufficiently to support the weight of a heavy patient large areas between the inflated tubes remain unsupported which make the patient uncomfortable. The patient should have the feeling of complete support.

U.S. Pat. No. 4,999,861 discloses a wave motion support having a series of parallel rigid slats which undulate to vary the pressure on a body supported on the bed. Cams are provided to cause the slats to follow a wave motion, traveling at a predetermined amplitude and periodicity along the longitudinal axis of the bed. The bed provides a pumping action against the surface of the patients skin varying from 6 to 75 mm Hg much like the systolic and diastolic pressures of the heart. This construction does not reduce the pressure to zero although the pressure on the skin varies with the height and periodicity of the wave. As the height of the wave increases, the lower pressure period in the middle of a cycle is reduced but the pressure at the beginning and end of the cycle increases as much as 10 times.

U.S. Pat. No. 5,010,608 discloses a bed having transverse cells similar to the Pegasus. The cells contain freon gas which is heated and cooled by coils beneath the cells to move alternate cells up and down. The pressure on the patient's body opposite a deflated cell is less than 20–32 mm Hg but does not reach zero. According to Kay M. Le (*Plastic and Reconstructive Surgery* 1984; 74 (VI): 745–54) pressures are higher within tissue than they are at the surface of the skin. Le found that while the surface pressure may remain below 25–30 mm Hg, internal pressure may be as much as 3 to 5 times greater near a bony prominence as compared to the skin over the prominence. Consequently, if the external pressure is reduced to 25–30 mm Hg the internal pressure may be as high as 75–80 or 125–150 mm Hg, much too high to permit the free flow of blood to the tissue. For this reason, it is imperative that pressure on the skin be reduced to zero for a sufficient time to permit blood flow and oxygen supply to the tissue to prevent ischemic injury.

Some of these prior art devices with inflatable tubes utilize noisy compressors which are irritating to the patient. The control means are often very expensive. Inflatable tubes are also subject to puncture which renders the device useless.

U.S. Pat. No. 4,947,500 discloses a therapeutic mattress having a elastic base of hard foam and a soft cover layer. A frame layer between the base and the cover layer houses an inflatable air cushion which can be rotated at 90 degrees. One group of air cushions may be inflated while the other group is deflated. It is alleged that this mattress prevents decubitus ulcers. There is no disclosure of reducing the pressure to zero.

SUMMARY OF THE INVENTION

The object of this invention is to provide a pressure relief bed which supports the patient without discomfort while reducing the pressure on selected portions of the body to zero mm Hg for a period sufficient to permit blood to flow to the tissue beneath the patients skin. Periodic flow of blood to the tissue prevents and even cures decubitus ulcers.

Another object is to provide a pressure relief bed which is of sturdy construction, relatively inexpensive to fabricate, positive in its operation, and noiseless in operation. The bed of the invention has a body support comprising a series of parallel padded slats extending from side to side, mounted for reciprocating motion, the slats being closely spaced. In a preferred form of the invention, the slats are 1½ inches wide and are spaced on 1¾ inch centers, thus leaving a gap or clearance of ¼ inch between the slats. Cam means are provided to move alternate slats downwardly out of the plane of the body support while slats on either side of the downwardly moving slats remain in the plane of the body support. After about two minutes the slats reverse position, so that the elevated slats move out of the plane of the body support while the lowered slats move up into the plane of the body support.

The slats have a rigid base and are covered with a strip of cellular plastic having density which permits some compression under the body weight of the patient. This compressible cellular material functions similarly to a spring in a mattress. It is essential that as the cellular material is compressed it does not expand laterally to the extent that it contacts the adjacent slats. Although closely spaced, the slats must move freely past each other. Covering the cellular plastic strip is a layer of soft foam having interconnecting cells which is relatively thin compared to the cellular plastic strip. The foam provides a soft surface which is comfortable to the patient similar to padding above the springs in a conventional mattress. The foam should not be thick enough or wide enough so that when compressed it interferes with the reciprocating movement of adjacent slats. The slats are covered with a flexible liquid-impervious film of plastic or the like. When the bed is in use the slats are covered with a bed sheet or similar covering.

The cellular plastics strip may be a closed cell polyolefin film which has a density of between two and ten pounds per cubic foot. In a preferred construction, several layers of foam of this kind are laminated together with the denser layers on the bottom and the less dense layers on the top. The soft foam on the top of the slat may be foam rubber or foamed polyurethene.

It is important that the mechanism provided for moving the slats operate silently so as not to disturb the patient. Yet it must be sturdy enough to support the weight of heavy patients without binding. One set of slats is mounted on side rails at each side of the bed to form a first rack. The slats are spaced sufficiently to permit alternate slats to pass between them. A second set of slats is mounted on side rails to form a second rack. The side rails of the second rack are spaced inwardly from the side rails of the first rack so that the racks may move up and down without interfering with each other. Vertical tubular guides are mounted on the bed frame to keep the racks properly aligned and to prevent any lateral or longitudinal movement thereof. The racks have upright posts that slide within the tubular guides. This is an important feature because any significant longitudinal movement on the rack relative to the other rack will cause interference of the slats as they move up and down.

To reciprocate the racks within the vertical guide tubes, the side rails have rollers which roll on cams attached to a carriage mounted for longitudinal movement on the bed frame. The weight of the racks is supported by the rollers. As the carriage moves back and forth, the cam surfaces slide under the rollers to lift and lower alternately the two racks and their interleaved slats. Preferably each rack has four rollers, two forward and two rearward, each roller cooperating with a cam on the moveable carriage. The contour of the cam is designed to lift the first rack to the plane of the body support and support it in elevated position for about two minutes as the carriage moves in one direction. As the carriage reverses direction the rollers move down the cam surface to lower the first rack. While the first rack is moving through this cycle, the second rack is lowered as the rollers supporting that rack roll down their mating cam surfaces. The cam contour has a dwell plateau which assures that the first rack does not move downwardly until the second rack is in elevated position. Since all of the cams are fixed to the same moveable carriage their contours are mirror images of one another.

Secured to the sides of the carriage are four rods, two on each side of the bed, which slide in bearings connected to the bed frame. This structure provides for smooth reciprocating action of the carriage and the cams which move with it. At the same time it supports the weight of the racks, and patient lying on the racks, through the rollers connected to the side rails of the racks. The carriage is actuated by a motor driven screw connecting to a cross member extending between the sides of the carriage. The screw rotates in one direction and then in the other direction to move the carriage back and forth in the bearings.

THE DRAWINGS

Other objects and features of the invention will appear from the following description when read in conjunction with the drawings in which FIG. 1 is a perspective view of a pressure relief bed constructed in accordance with the invention.

FIG. 2 is a transverse sectional view taken along the line 2—2 of FIG. 1.

DETAILED DESCRIPTION

Figure 3:
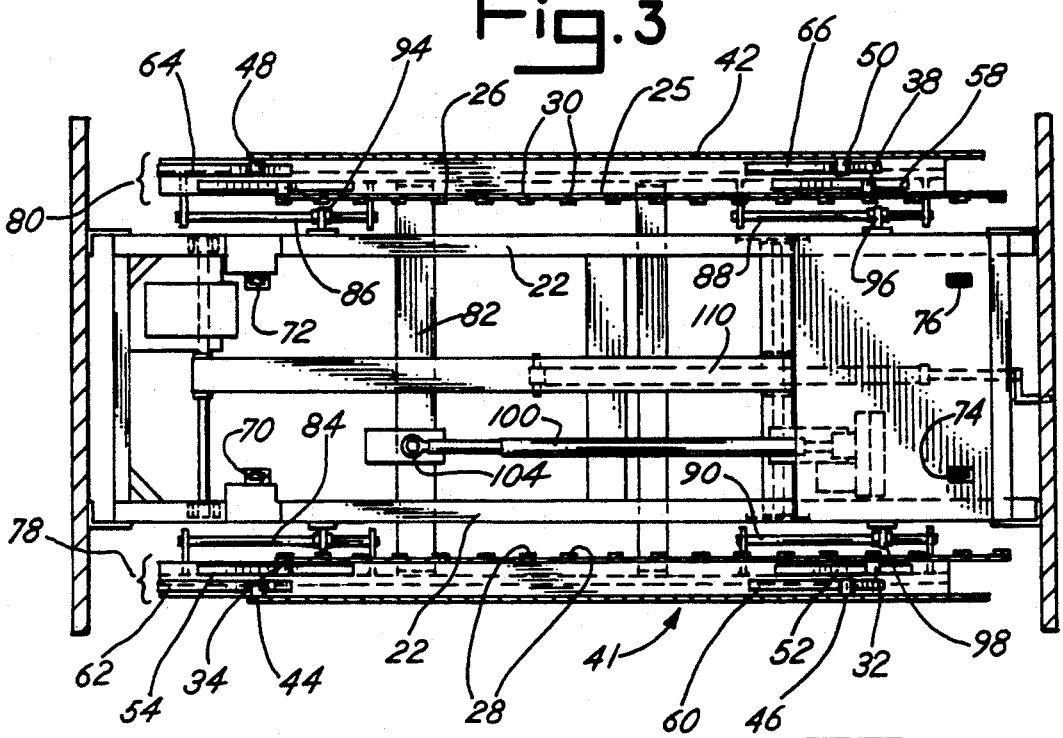
FIG. 3 is a plan sectional view taken along the line 3—3 of FIG. 2.

The bed designated generally at 10 has a body supporting surface consisting of a series of transverse, slightly spaced slats 12, 14. The slats 12 are supported by side rails 24, 26 and the slats 14 are supported by side rails 40, 42, which are spaced outwardly from the side rails 24, 26. The slats 12, 14 comprise a metal base 13 which is T-shaped in cross section. Mounted above the base 13 are strips of compressible closed cell polyolefin plastic material. Strip 15 has a density of about 10 pounds per cubic foot, strip 17 has a density of about 7 pounds per cubic foot and strip 19 has a density of about 4 pounds per cubic foot. The top strip 21 is of soft foam rubber or polyurethane plastic having interconnecting cells. The compressible strips are covered over with a sheet of polyvinyl chloride or other water resistant material.

It will be appreciated that compressible materials of varying densities can be employed. It is also possible to make the compressible materials removable so that they can be replaced with material having a different density depending upon the weight of the patient being supported on the bed. It is important that the compressible strips do not expand laterally under the patient's weight so that they interfere with each other as the slats move up and down.

The base members 13 are connected to side rails by means of upright members. The slats 12 are supported by uprights 28, 30 which are secured at their lower ends to side rails 24, 26. Side rail 24 has a pair of rollers 32, 34 at opposite ends thereof. Similarly, side rail 26 has a pair of rollers 36, 38. These rollers which bear on cam surfaces support the entire weight of the rack 25 which includes all of the slats 12, and the weight of the patient on the rack.

Figure 4:
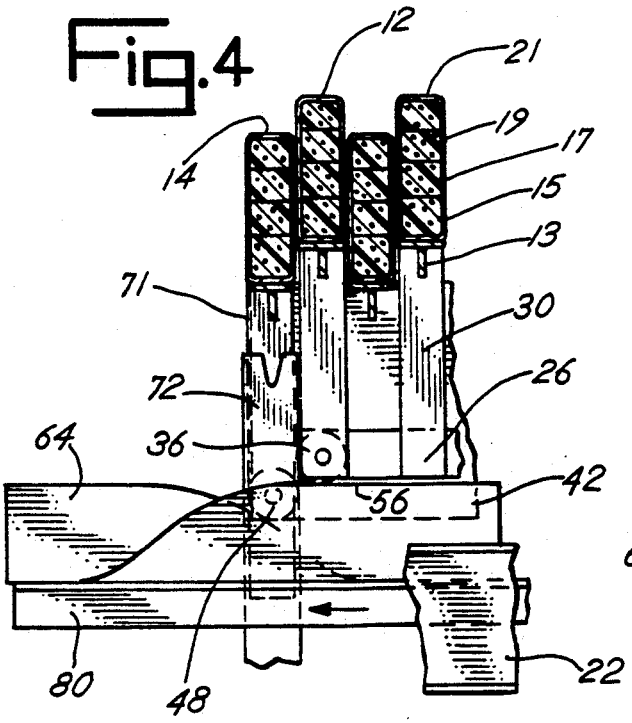
FIG. 4 is a detailed section of a portion of a rack showing the cam mechanism for raising and lowering the slats when the carriage is moving to the left.

To ensure that the rack 25 and the slats 12 move up and down without any lateral movement, vertical guides 72, 74, are secured diagonally to the frame 22 of the bed. Rod members 71, as shown in FIG. 4, slide in the tubular upright guides 72–74. The upper ends of the rods 71 are welded to slat bases 13 diagonally at opposite sides of the bed. As the rollers 32–38 move up and down under the influence of the cams, the rods 71 slide up and down within the tubes 72–74.

In a similar manner the bases 13 which support the slats 14 are secured to the outer side panels 40, 42. This assembly forms a second rack 41, as indicated in FIG. 3. Rollers 44, 46, 48 and 50 are mounted on the inside surface of the outer side rails 40, 42 of the rack 41. Cam members 52, 54, 56, 58 are mounted on the side plates of carriage 78, 80 directly beneath rollers 32, 34, 36, 38 to support rack 25. In a similar manner the cam members 60, 62, 64, 66 are mounted on the same carriage plates directly below rollers 44, 46, 48 and 50 on the side rails 40, 42 to support rack 41. The rack 41 has upright rods which slide in tubular guide members 70, 76 connected diagonally to the frame of the bed in the same manner as the vertical guides for rack 25.

The carriage, which carries all of the cams, is mounted on the frame of the bed by means of rods 84, 86, 88 and 90 connected to the carriage by brackets and bearings 92, 94, 96, 98 which are secured to the frame 22. This construction facilitates smooth reciprocating motion of the carriage as it moves back and forth carrying the cams which support the racks.

The longitudinal plates 78, 80 comprising the carriage are moved back and forth by means of cross-member 82 which is connected to a screw 100 driven by a motor transmission assembly 102. The end of the screw is connected to a pin 104 on the cross-member 82. The motor reverses rotation which in turn causes the screw to move in and out, thus providing the force to oscillate the carriage on the four bearings 92, 94, 96 and 98.

Figure 5:
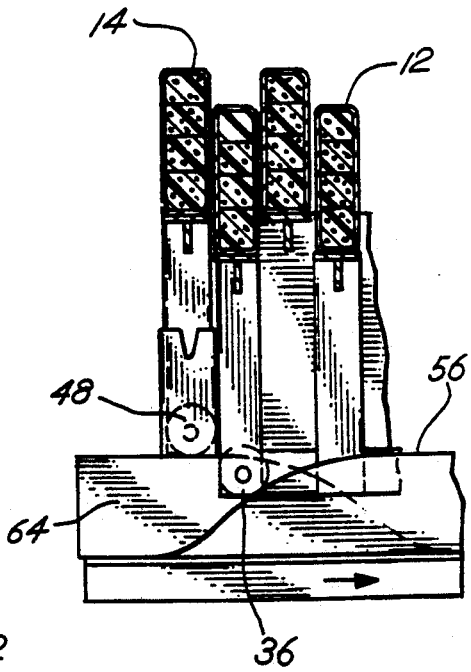
FIG. 5 is a view similar to FIG. 4 showing the position of the slats when the carriage is moving to the right.
Figure 6:
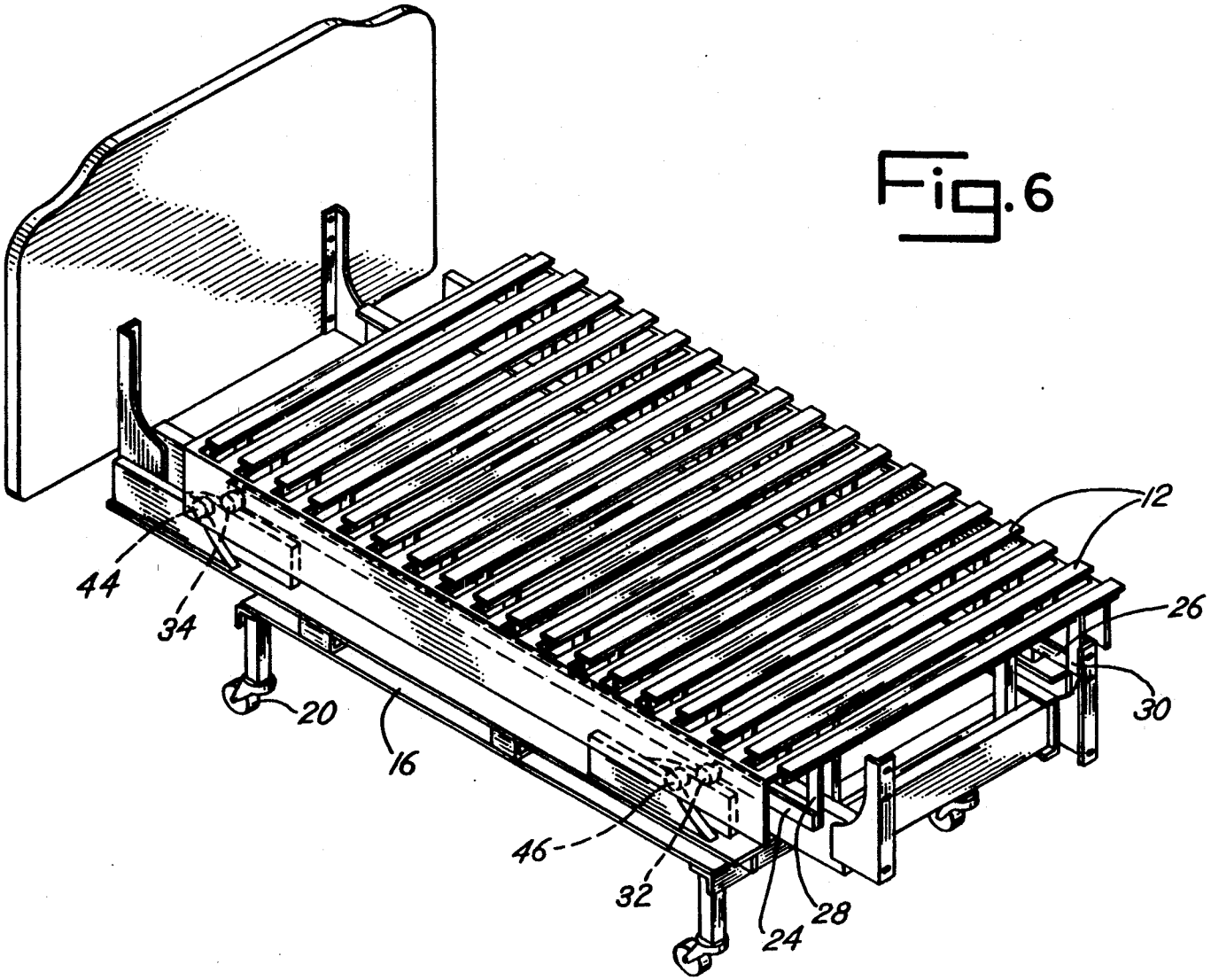
FIG. 6 is a perspective view of the bed with the outer side rail removed to expose the cams and rollers for lifting and lowering the racks including the slats on one side of the bed.

As best shown in FIG. 4, the cam followers or rollers rest on the surface of their cooperating cams. Roller 36 on the inner rail 26 follows the contour of the cam 56. As indicated by the arrow in FIG. 4, the carriage is moving to the left. Thus, the roller 36 and all of the other rollers which are connected to the inner rack 25 move simultaneously up the slope of the cam to the top flat portion thereof, thus placing the slats 12 in elevated position. They remain in elevated position during the time the carriage completes its stroke in moving to the left in FIG. 4. The slats 12 remain elevated after the carriage reverses its direction until such time as the slope of the cam is inclined downwardly, whereupon the slats 12 which are supported by the rollers move down as part of the rack 25. Similarly, the cam follower or roller 48 and similar rollers 44, 46 and 50 follow the contour of their respective cams 64, 62, 66 and 60. As the carriage moves to the left as shown in FIG. 4, the rollers supporting the rack 41 move down the slope of the cam 64 and similar cams to lower the slats 14. When the carriage reverses direction as indicated by the arrow in FIG. 5, the roller 48 moves up the incline of cam 64 to raise the slat 14 to elevated position. Here again, all four of the rollers supporting the rack 41 move in unison as their respective cams advance. Simultaneously, the rollers, such as 36, which support the rack 25 and its associated slats 12, moves down the cam surface 56 to lower the slats 12 below the surface of elevated slats 14.

The mechanism indicated generally at 110 is the screw and crank assembly for raising and lowering the head of the bed and constitutes no part of the present invention.

From the foregoing description it is apparent that the parallel spaced slats 12 alternate with the similar slats 14 to support the weight of the patient over particular portions of his body while the alternate slats are recessed out of contact with the body. The amount of time the slats are in elevated and recessed positions is determined by the profile of the cams. The profile of cams may be modified to lengthen or shorten the contact time. Unlike the pneumatic tubular supports, the unsupported areas of the patient's body between alternate slats is relatively small. Consequently, the tendency for the body or any portion thereof to sag between elevated slats is eliminated. This ensures that the unsupported portions of the body are at zero pressure. There is no possibility of the slats "bottoming out". Furthermore, the slats are designed with compressible material which does not distend laterally to contact the body over a larger area than the surface area of the elevated slats. On the other hand, the slats are not hard and unyielding so as to be uncomfortable for the patient. The mechanism for reciprocating the carriage works smoothly and silently as do the rollers which move over the surface of the cams. By providing vertical guides the two racks move up and down without interfering with each other due to "slop" in the connections between the racks and the mechanical means for elevating and lowering them.

What is claimed is:

1. A pressure relief bed which eliminates pressure on a patient at frequent periodic intervals comprising a frame, a first rack mounted for vertical movement on said frame, said rack comprising a series of cross slats spaced from each other and secured to a pair of side rails, a second rack also mounted for vertical movement on said frame comprising a series of cross slats disposed in said spaces between the cross slats in said first rack, said cross slats on said second rack being secured to side rails spaced inwardly from said side rails in said first rack to provide space therebetween, rollers mounted on said side rails within the space between said side rails, a carriage mounted on said frame for longitudinal movement, a cam member mounted on said carriage adjacent each of said rollers, each cam member having a contour which causes the adjacent roller to rise and dwell as the carriage moves in one direction and to dwell and fall as the carriage moves in the opposite direction, whereby, as the carriage moves in one direction, said first rack is lowered with respect to the second rack while the second rack remains elevated and as the carriage moves in the opposite direction, said rack is lowered with respect to said first rack while said first rack remains elevated.

2. The bed of claim 1 which includes vertical guide tubes connected to said frame and vertical rods connected to said rack which rods telescope with said tubes to cause the racks to move only vertically.

3. The bed of claim 1 in which said carriage has longitudinally-mounted rods at each side of the bed which rods slide in bearings secured to the bed frame.

4. The bed of claim 1 which includes a cross member extending from one side of said carriage to the other, said cross member being connected to a rotatable screw on said frame and a reversible motor for rotating the screw in one direction to move the carriage forward and in the opposite direction to move the carriage backward.

5. A pressure relief bed, having a body support defining a substantially horizontal plane and which eliminates pressure on a patient at frequent periodic intervals comprising a frame, a first rack mounted for vertical movement on said frame, a series of parallel slats defining said plane spaced from each other and fixed to said rack, a second rack also mounted for vertical movement on said frame, a series of parallel slats fixed to said second rack and disposed in the spaces between said parallel slats on said first rack, means for moving said first rack and the series of slats thereon out of the plane of said body support while said second rack remains in said plane and subsequently moving said second rack and the series of slats thereon out of the plane of said first rack while said first rack remains in said plane, and repeating said movements alternately whereby portions of said patient's body are supported by the slats on one rack while other adjacent portions of said body are completely free of supports.

6. The bed of claim 5 in which said slats are approximately 1½ inches wide and are closely spaced, but move freely past each other.

7. The bed of claim 6 in which said slats have a rigid base and are covered with compressible elastic strips.

8. The bed of claim 7 in which said slats are slightly spaced from each other and the density of said compressible elastic strips is selected so that they do not distend laterally under compression into the slight space between the slats to interfere with their movement.

* * * * *